US005279362A

United States Patent [19]

Pool

[11] Patent Number: 5,279,362

[45] Date of Patent: Jan. 18, 1994

[54] WELL SCREEN AND COMPLETION DEVICE HAVING AN ATTACHED GRAVEL PACK

[76] Inventor: James R. Pool, 308 Colorado St., P.O. Box 1201, Athens, Tex. 75751

[21] Appl. No.: 875,229

[22] Filed: Apr. 28, 1992

[51] Int. Cl.[5] ..... E21B 43/04

[52] U.S. Cl. ..... 166/51; 166/228

[58] Field of Search ..... 166/51, 228, 236, 278

[56] References Cited

U.S. PATENT DOCUMENTS 1,291,915 1/1919 Kelley ..... 166/51
2,877,852 3/1959 Bashara ..... 166/236
3,107,727 10/1963 Howard ..... 166/228
4,003,429 1/1977 Hay et al. ..... 166/51
4,856,591 8/1989 Donovan et al. ..... 166/278
5,004,049 4/1991 Arterbury ..... 166/228

*Primary Examiner*—Ramon S. Britts
*Assistant Examiner*—Frank S. Tsay
*Attorney, Agent, or Firm*—Ross, Howison, Clapp & Korn

[57] ABSTRACT

A fabric sleeve is used to hold gravel pack granular material in place over the open (slotted, perforated, punched, louvered, etc.) portions of a well screen. A well screen is described having an attachment device oriented to form longitudinal fabric sleeve pockets parallel to the longitudinal axis of the well screen. The pockets are filled with a gravel pack material.

5 Claims, 3 Drawing Sheets

WELL SCREEN AND COMPLETION DEVICE HAVING AN ATTACHED GRAVEL PACK

TECHNICAL FIELD OF THE INVENTION

This invention relates to gravel pack (granular material) held in place over the open (slotted, perforated, punched, louvered, etc.) portions of a well screen prior to the installation of the well screen in a bore hole.

BACKGROUND OF THE INVENTION

Gravel pack material (granular material) is commonly used in well construction to stabilize the bore hole and provide filtration to prevent fine grain formation material from entering the well with the liquids or gasses produced. There is considerable advantage in providing a means of attaching a gravel pack filter to the well screen itself prior to the installation of the well screen in the bore hole, as the well driller has then assured that the well can be completed in a manner which will not produce formation material (sand).

There is an existing design which attaches the gravel pack material to the well screen by cementing granular material to the well screen (e.g.; "Aquastream", U.S. Pat. No. 4,624,314). This design results in a product which is somewhat fragile and may not be easily cleaned of clogging formation material or drill cutting. An improvement in that design is described in this application and is achieved by forming the outside shape of the granular envelope with a wave-like or bumpy surface with channels which allow free movement of well cleaning fluid around the outside of the screen, and having its thicker portions covering the slotted (open) sections of the well screen and its thinner parts at the places which are not slotted.

Another presently available well screen design uses granular material in the cavity between two telescoping well screens (Western K-L Associates, Inc. "Pre-Pac" dual wall well screen). This product is in some cases somewhat heavy and larger in diameter than desirable because of the need to use commonly available pipe sizes. Also, the open area available to transmit fluids into the well must be limited to that which can be produced by that slot size which is usable to retain the size of the gravel used in the gravel pack.

Another type of well screen now available uses two wire wound well screens (one inside the other) with a granular gravel pack between them (Johnson Filtration Systems: "Channel Pack (TM)"). This product was borrowed from existing petroleum production technology. The well screen produced is excessively expensive, is of a high shipping weight and its excessive diameter is a disadvantage.

SUMMARY OF THE INVENTION

The present invention disclosed and claimed herein comprises a well screen with a gravel pack sleeve. The well screen consists of a cylindrical well screen having a hollow bore with open ends and a perforated wall. A longitudinal sleeve is provided having an inner diameter that is larger than the outer diameter of the well screen. The longitudinal sleeve is flexible and porous and disposed about at least a portion of the well screen. A segmenting device is provided for segmenting portions of the space between the inner diameter of the longitudinal sleeve and the outer diameter of the well screen to form pockets. A gravel packing material is then disposed in the pockets.

In another aspect of the present invention, the pockets are formed by disposing longitudinal ribs adjacent to the outer surface of the longitudinal sleeve and secured to the well screen such that the space between the sleeve and the well screen on either side of the ribs is isolated. Clamping devices are provided at either end of the longitudinal sleeve for securing the respective end of the longitudinal sleeve to the outer surface of the well screen. The longitudinal ribs extend between the two clamps.

In a further aspect of the present invention, the gravel pack is disposed within the pockets by disposing the longitudinal sleeve and screen combination within a longitudinal tube having an inner diameter that is smaller than the outer diameter of the longitudinal sleeve. A funnel is disposed at the upper end of the longitudinal tube with the longitudinal sleeve being secured to the lower end of the funnel at the smallest opening thereof. The inner diameter of the smallest opening of the funnel is larger than the outer diameter of the well screen, the well screen extending upward and out of the funnel. Gravel packing material can then be disposed in the funnel to communicate and flow into the space between the inner surface of the longitudinal sleeve and the outer surface of the well screen. When the gravel packing material is disposed within the interior space between the sleeve and well screen, an access opening is provided in the longitudinal tube for allowing the clamping devices to be placed on the screen/-sleeve assembly.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
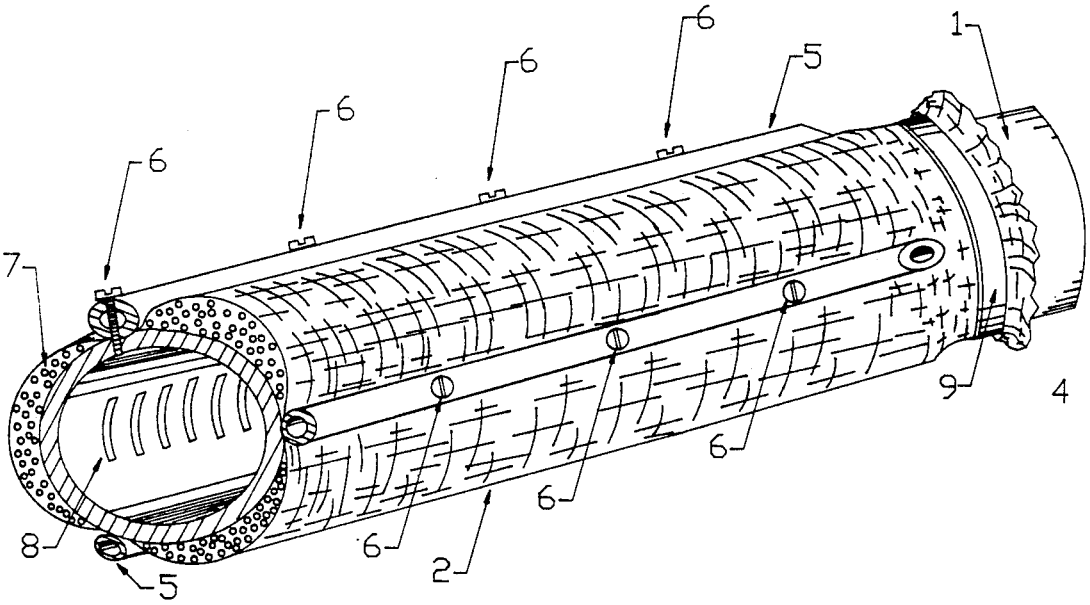
FIG. 1 is a perspective view of an embodiment showing a well screen with an attached fabric sleeve and containing gravel pack material being held in longitudinal fabric pockets in place over the slotted portions of the well screen by a rib structure held in place by an attachment screw device.

Referring now to FIG. 1, there is illustrated a perspective view of a Segmented Fabric Gravel Pack Sleeve. A well screen 1 is surrounded with a fabric sleeve 2 (for example a sleeve made of polyester knit cloth; stainless steel wire cloth, PVC coated polyester fabric, etc.). The sleeve is divided into longitudinal pockets (segments) at intervals around the screen. The segments are maintained by ribs 5 held in place between each pocket with attachment devices 6 which can be screws, rivets, glue, welding, etc. The preferred attachment device 6 comprises screws. The ribs 5 are spaced around the circumference of the well screen 1 so as to place the gravel pack granular material 7 (which is placed in each pocket) over the open portions (slots) 8 of the well screen 1; a clamp 9 is provided at each end of the fabric sleeve 2 to prevent escape of gravel pack granular material 7. A space 3 (not shown on FIG. 1) is provided at the top of the well screen 1 that is not slotted (no openings) thus to accommodate some settling of the said gravel pack 7. In addition, the upper end 4 of the sleeve 2 can be unclamped to allow addition of granular material 7 if needed prior to installation of the completed assemble in the well hole.

The fabric 12 passing under the ribs 15 is held in place between the ribs 15 and the well screen 11 by the attachment screws 16. The description of this embodiment should not be construed to limit the invention to this one embodiment only, for the attachment of a gravel pack using a fabric sleeve can be done in other ways, as will be described hereinbelow.

Figure 2:
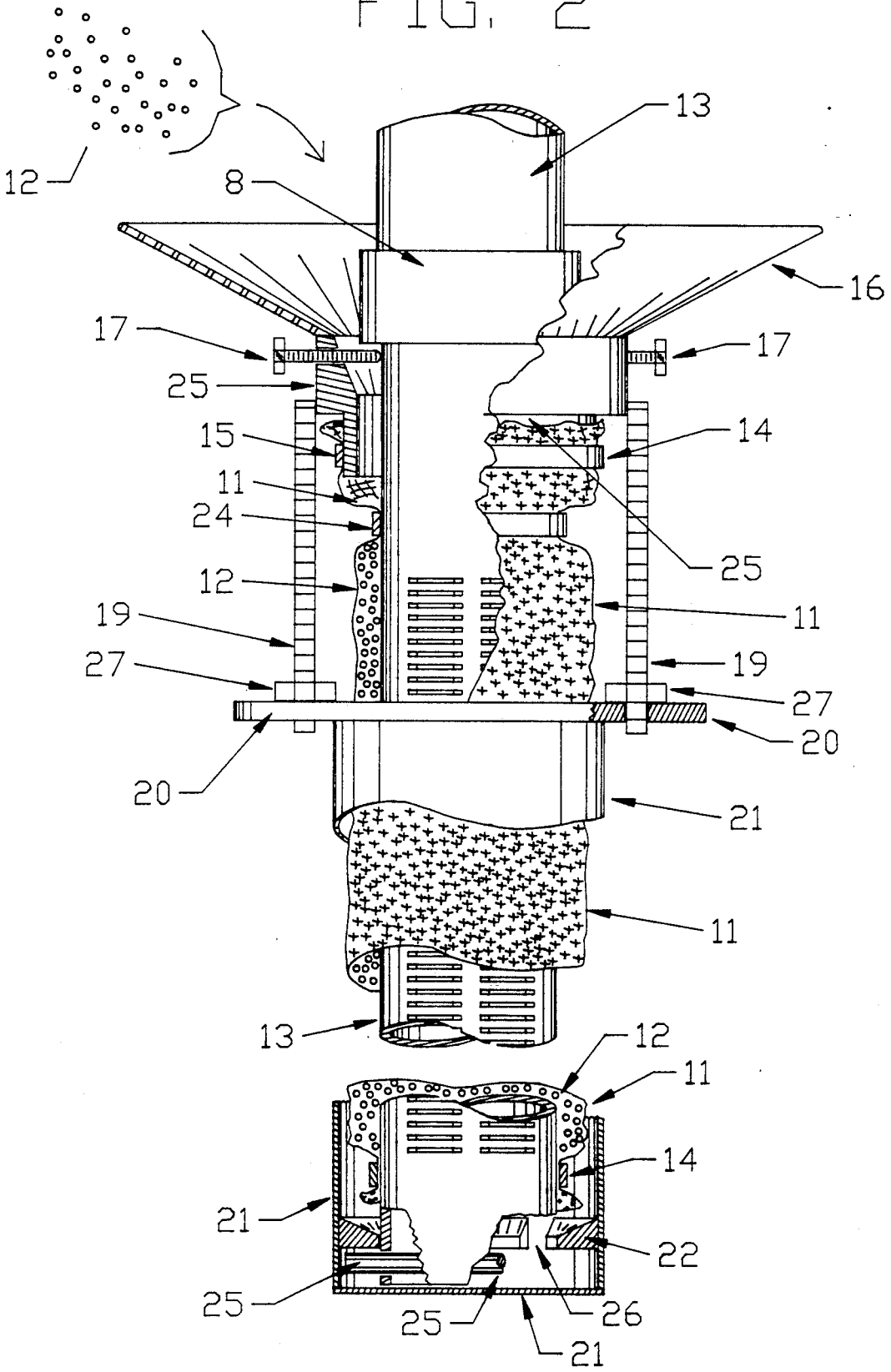
FIG. 2 is a side view with cut-out portions showing inside details of the funnel embodiment of the invention, wherein a well screen is placed in a tube through a funnel and inside a fabric sleeve to receive gravel pack material and then to allow the fabric sleeve to be held by a clamp after well screen gravel pack is installed therein.

Referring now to FIG. 2, there is illustrated another embodiment of the present invention, a Gravel Funnel Sleeve. This embodiment comprises a fabric sleeve 11 to hold gravel pack material 12 around a well screen 13. The fabric sleeve 11 is attached on its lower end around the lower end of screen 13 with a lower clamp 14. The upper end of the sleeve 11 is attached with an upper clamp 15 to a funnel 16; the funnel 16 having a plurality of centering bolts 17 arrayed around the middle part of the funnel 16 to center the well screen 13 in the funnel 16 and the bolts 17 being useful to support the well screen 13 in the funnel 16 when the screen 13 is joined using a coupling device 18 whenever the coupling device 18 is supported by the bolts 17. The funnel 16 is connected on its lower end with a plurality of threaded support rods 19 to a ring 20. The rods 19 are free to move (not threaded into) in the ring 20. The ring 20 connected to the top end of a tube 21. The separation provided by the rods 19 between the funnel 16 and the tube 21 provide access to the screen 13 and its surrounding fabric sleeve 11 below the funnel 16. The tube 21 serves to center the sleeve 11 and its contained gravel pack material 12 around the well screen 13. The well screen 13 is centered in the funnel 16 by the bolts 17 and in the tube 21 by a lower centering ring 12. An upper clamp 14 is used, after the sleeve 11 is about filled with gravel pack material 12, to close off the top of the sleeve 11 and hold the gravel pack 12 around the screen 13.

In those situations where the screen is crooked (as for example PVC well screen is sometimes bowed), some straightening can be accomplished temporarily during placement of gravel pack material 12 by tensioning the screen 13. For this purpose, a pin 23 is installed in holes penetrating the screen 13 and the pin 23 is then placed below the lower ring 22 by passing the pin 23 through open areas 26 in the lower ring 12 and then by turning the screen 13 to one side (by for example ¼ turn), the screen 13 can be held on its lower end by the pin 23 below the ring 12, thus serving to anchor the screen 13 on its lower end. When tension is placed on the screen 13 (by for example a drilling rig or hoist used to lift the well screen 13 into place, or by turning the nut 27 on the bottoms of the threaded rods 19) the screen 13 will have a tendency to be held straight.

The threaded rods 19 are used when the top of the sleeve 11 has been attached to the bottom part of the funnel 16 (and the screen 13 has been straightened by applying tension). The sleeve 11 can be tensioned by turning nut 27 on the bottoms of the threaded rods 19 so as to raise the entire assemblies. The sleeve 11 is thereby tightened and tensioned in the vertical direction, provided however that the centering bolts 17 shall have been loosened somewhat to prevent hanging on the well screen 13 or on any coupling 18 on the well screen 13. In practice a well screen 13 with an attached sleeve 11 is lowered into the funnel 16 and its attached tube 11. The top of said sleeve 11 is then attached with a clamp 15 around the lower opening 25 of said funnel 16.

If it is determined that the screen 13 may be crooked and can be made at least temporarily straight if held under tension, then a pin 23 can be placed through holes in the bottom of the screen 13. If the bottom of the screen 13 should be threaded, for example, and there is reluctance to make holes in it at that location, then a fitting may be attached (not shown on FIG. 2) wherein the holes may be made. The bottom of the screen 13 is anchored to the bottom of the tube 21 by lowering the pin 23 through the openings 22 and then turning the screen 13 to place the pin ends 23 away from the openings 22. When tension is placed on the screen 13, any bow will have a tendency to be temporarily removed and the lower part of the screen 13 will be centered in the tube 21. Then the nut 27 may be turned to raise the funnel assembly 16, thus to tension the sleeve 11.

Then gravel pack material 12 is directed to the space between the sleeve 11 and the screen 13 by placing the gravel 12 in the funnel 16. A clamp 24 is used to close the sleeve 11 after sleeve 11 is filled with gravel 12. Next, the top clamp 15 is removed and the well screen 13 with attached gravel pack can be removed from the tube 21 and funnel 16 by turning the screen 13 slightly to aline the pin ends 23 with the openings 26 in the lower ring 22 and then extracting the screen 13 with attached gravel pack.

In addition, it should be noted that even though a slotted well screen is described in FIGS. 1 and 2, it is understood that various well screen designs could equally well have been used (i.e., wire-wrapped, wrapped on bar, wrapped on pipe, louvered, punched, milled, etc.) the requirement being that the screen retain a significant portion of the gravel pack material and prevent it from entering the well screen.

Figure 3:
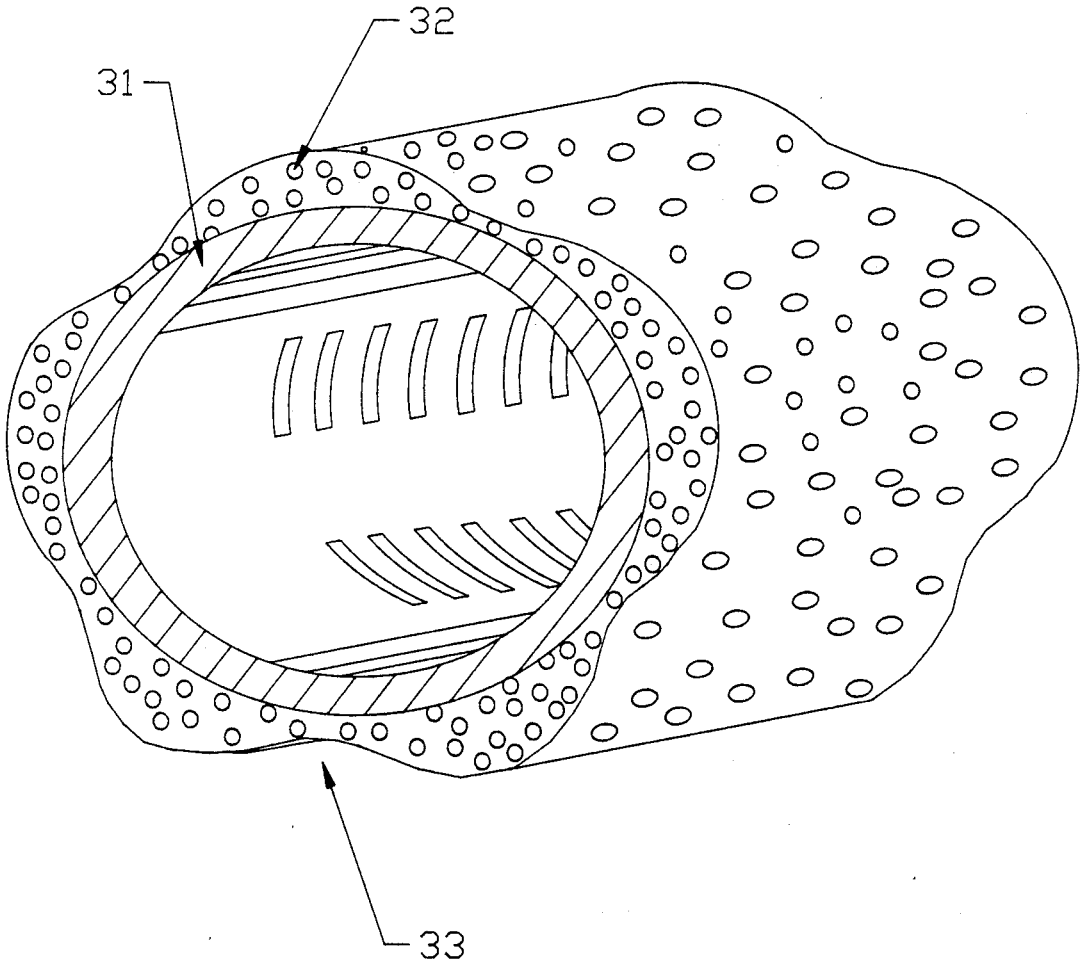
FIG. 3 is a perspective view of the invention showing the outside shape of a particular embodiment of the invention having a channeled outer shape.

Referring now to FIG. 3, there is illustrated a gravel packed well screen made by attaching to a well screen 31 by gluing, forming in place, etc., the granular materials 32 on the outside of the well screen 31. If it is provided that the shape of the gravel pack material 32 is such as will allow free circulation of completion (cleaning) fluids around the outside of the screen/gravel pack assembly then some assurance can be had that the well bore hole can be more easily cleaned of drill cuttings, drilling mud, etc., which would otherwise be more difficult to remove. For example, the outside shape of the screen/gravel pack is as shown in FIG. 3 wherein the relatively thin zones 33 are located in those places where there are no slots in the well screen 31 and the relatively thick zones are located over the slotted areas. These zones are disposed in places that will provide long channels 33 where circulating bore hole cleaning waters can freely circulate. If the well screen is placed in a crooked hole, or a crooked well screen is placed in a drill hole, or if a well screen is installed in a hole where a tight fit or other obstructions exist, then the portion of the well screen above and at the obstruction will not be protected from the circulating waters but instead will more likely be cleaned because the water (cleaning fluids) can reach all parts of the bore hole.

This same shape concept, whether a gravel pack is attached or not, is applicable to other well screen designs wherein the shape in cross-section has corners thus to provide open circulation zones between the corners; as for example in the well screen described in FIG. 1 above.

Although the preferred embodiment has been described in detail, it should be understood that various changes, substitutions and alterations can be made therein without departing from the spirit and scope of the invention as defined by the appended claims.

What is claimed is:

1. A well screen with a gravel pack sleeve, comprising:

a cylindrical well screen having a hollow bore and open ends with a plurality of perforations disposed along the length of said cylindrical well screen in a predetermined pattern to form a perforated wall;

a longitudinal sleeve having an inner diameter larger than the outer diameter of said cylindrical well screen and being flexible and porus, said longitudinal sleeve disposed about at least a portion of said well screen to form a space between the outer surface of said well screen and the inner surface of said longitudinal sleeve; and a gravel packing material disposed in said space and in contact with said perforated wall of said cylindrical well screen.

2. The well screen of claim 1 wherein said longitudinal sleeve is comprised of a fabric material.

3. The well screen of claim 1 and further comprising a segmenting device for substantially segmenting portions of the space between the inner surface of said longitudinal sleeve and the outer surface of said cylindrical well screen into pockets, said segmenting device comprises a plurality of longitudinal ribs disposed substantially parallel to the longitudinal axis of said cylindrical well screen for securing a portion of the surface of said longitudinal sleeve to the outer surface of said cylindrical well screen and secured thereto such that the portion of said longitudinal sleeve between said longitudinal ribs comprise said pockets, and at least two clamps, one each disposed at opposite ends of said longitudinal sleeve for securing the respective ends of said longitudinal sleeve to the surface of said cylindrical well screen, said longitudinal ribs extending between said clamps.

4. A well screen with a gravel pack sleeve, comprising:

a cylindrical well screen having a hollow bore and open ends with a plurality of perforations disposed along the length of said cylindrical well screen in a predetermined pattern to form a perforated wall;

a gravel packing material disposed on the outer surface of said cylindrical well screen and attached to the outer surface of said cylindrical well screen with an adhesive material; and said gravel packing material having longitudinal channels formed on the outer surface thereof to allow fluids to pass around said gravel packing material.

5. An apparatus in combination with a cylindrical well screen and forming a gravel pack about the outer surface thereof, said cylindrical well screen having a hollow bore and open ends with a perforated wall, said apparatus comprising:

a longitudinal sleeve having an inner diameter larger than the outer diameter of the cylindrical well screen and being flexible and porus, said sleeve disposed about at least a portion of the outer surface of the well screen;

a longitudinal tube having an inner diameter larger than the outer diameter of said longitudinal sleeve such that said sleeve and the cylindrical well screen as an assembly can be disposed within said tube;

a funnel disposed about the upper end of said tube;

centering means for centering the well screen and said longitudinal sleeve within said tube;

access means disposed about the upper end of said tube;

a first clamping device for being disposed through said access means to attach said longitudinal sleeve to the cylindrical well screen at the upper end thereof;

a second clamping device for being disposed at the opposite end of said longitudinal sleeve from said first clamping device to attach said sleeve to the cylindrical well screen; and said funnel allowing gravel pack to be disposed within the space between the inner surface of said longitudinal sleeve and the outer surface of the cylindrical well screen prior to disposing said first clamping device through said access means.

* * * * *